US011603168B2

(12) United States Patent
Jean et al.

(10) Patent No.: US 11,603,168 B2
(45) Date of Patent: Mar. 14, 2023

(54) FOLDING CLEAT

(71) Applicant: Wen-Fong Jean, Taoyuan (TW)

(72) Inventors: Wen-Fong Jean, Taoyuan (TW); Da-Zen Jean, Taoyuan (TW); Tai-Lien Huang, Taoyuan (TW); Pai-I Kao, Taoyuan (TW)

(73) Assignee: Wen-Fong Jean, Taoyuan (TW)

( * ) Notice: Subject to any disclaimer, the term of this patent is extended or adjusted under 35 U.S.C. 154(b) by 152 days.

(21) Appl. No.: 17/358,151

(22) Filed: Jun. 25, 2021

(65) Prior Publication Data

US 2022/0388608 A1 Dec. 8, 2022

(30) Foreign Application Priority Data

Jun. 2, 2021 (TW) ..... 110206378

(51) Int. Cl.
*B63B 21/04* (2006.01)

(52) U.S. Cl.
CPC ..... *B63B 21/045* (2013.01)

(58) Field of Classification Search
CPC ..... B63B 21/04; B63B 21/045; B63B 21/08
USPC ..... 114/218
See application file for complete search history.

(56) References Cited

U.S. PATENT DOCUMENTS 4,270,478 A * 6/1981 Kafka ..... B63B 21/045 114/218
4,964,355 A * 10/1990 Milewski ..... B63B 21/045 114/218
5,438,944 A * 8/1995 Burke ..... B63B 21/045 114/218
D401,842 S * 12/1998 Johnson, Jr. ..... B63B 21/045 D8/356
7,131,387 B1 * 11/2006 Czipri ..... B63B 21/045 114/218
D615,019 S * 5/2010 Jien ..... B63B 21/045 D8/356

(Continued)

FOREIGN PATENT DOCUMENTS

CN 109004836 A 12/2018
CN 109217687 A 1/2019

OTHER PUBLICATIONS

Research on Multilevel Converter for Direct Drive Wind Power System, Journal of Northeast Dianli University, vol. 30, No. 1, Feb. 2010.

*Primary Examiner* — Daniel V Venne
(74) *Attorney, Agent, or Firm* — Kirton McConkie; Evan R. Witt

(57) ABSTRACT

The present invention provides a folding cleat. The folding cleat includes a base, a handle component and an elastic component. The base includes a pivot slot and an accommodation space connected with each other. The handle component includes a supporting portion and a handle portion. The supporting portion includes a rotating shaft disposed at an end of the supporting portion and is pivotally connected to the base. The handle portion extends outward from the other end of the supporting portion. The rotating shaft includes a first positioning element and a second positioning element disposed on an outer peripheral edge of the rotating shaft, respectively. The elastic component is fixed to the base and includes a pushing portion. The pushing portion spatially corresponds to the first positioning element and the second positioning element.

10 Claims, 12 Drawing Sheets

(56) References Cited

U.S. PATENT DOCUMENTS

D645,332 S * 9/2011 Tung ..... B63B 21/045
D8/356
D961,368 S * 8/2022 Li ..... B63B 21/045
D8/356

* cited by examiner

FOLDING CLEAT

FIELD OF THE INVENTION

The present disclosure relates to a boat cleat, and more particularly to a folding cleat facilitating installation and application in limited space on a boat, providing the function of fixing ropes, and meeting the needs of aesthetic appearance and convenience of storage.

BACKGROUND OF THE INVENTION

Nowadays, boats are usually equipped with cleats for fixing ropes according to the user's requirement. A conventional cleat includes a main body and a handle component. The main body of the conventional cleat is fixed to the boat, and the handle component is extended from the main body to both sides, so that it looks like goat horns. Therefore, this type of cleat is also called as a horn cleat.

The function of the cleat is to fix the rope, so the handle component should have enough operating space. However, while the handle component is not used for fixing the rope, it still remains exposed and extended outwardly. In addition to occupying space, there is also a safety concern that people on the boat may be accidentally tripped over the cleat.

On the other hand, the long-term exposure of the handle component of the cleat to the outside of the boat not only cause safety concerns, but also is unsightly. In addition, due to the limited space of the boat, it is necessary to ensure that any accessories installed on the ship will not slide or fall off during the voyage, which may affect safety.

Therefore, there is a need to provide a folding cleat with simple structure, convenient operation, safety, reliability, low cost and long service life. The folding cleat is accurately fixed and positioned during folding and unfolding, which not only provides the function of fixing but also has aesthetic appearance and convenience of storage, and further prevents the handle component from sliding or falling off, effectively solving the problems stated above.

SUMMARY OF THE INVENTION

An object of the present disclosure is to provide a folding cleat with simple structure, convenient operation, safety, reliability, low cost and long service life. By rotating a handle component relative to a base to fold and unfold the cleat, the cleat installed in a limited space on a boat not only provides the function of fixing the rope, but also achieves the effects of aesthetic appearance, safety, and convenience of storage.

Another object of the present disclosure is to provide a folding cleat. When a handle component is rotated relative to a base, an elastic component is pushed against a first positioning element or a second positioning element of a rotating shaft of the handle component, so that the handle component is positioned at a first position or a second position, respectively. Thereby, the purpose of fixing and positioning the handle component during folding and unfolding operations is achieved, the sliding or falling off of the handle component is avoided, and the safety of navigation is ensured.

A further object of the present disclosure is to provide a folding cleat. The entire structure of the folding cleat is compact and easy to assemble. With a rotating shaft of a handle component inserted into a pivot slot of a base, the rotating shaft of the handle component is limited in the pivot slot of the base through an elastic component fixed to the base, and a pushing portion of the elastic component is constantly pushed against the rotating shaft. Thereby, the folding cleat is assembled. The purpose of fixing and positioning is achieved by rotating the handle component relative to the base. Furthermore, when the folding cleat is folded, the handle component and the base are overlapped into a minimum volume. It facilitates storage and application of the folding cleat in a limited space.

In accordance with an aspect of the present disclosure, a folding cleat is provided. The folding cleat includes a base, a handle component and an elastic component. The base is configured to be installed on a boat and includes a first lateral side, a second lateral side, a pivot slot and at least one accommodation space. The first lateral side and the second lateral side are two opposite sides. The pivot slot is disposed adjacent to the first lateral side, the at least one accommodation space is disposed between the first lateral side and the second lateral side, and the pivot slot and the at least one accommodation space are connected with each other. The handle component is rotatably connected to the base and includes at least one supporting portion and at least one handle portion. At least one supporting portion includes a rotating shaft disposed at a first end of the at least one supporting portion, extended along an axial direction and passed through the pivot slot, so that the at least one supporting portion is pivotally connected to the base. The at least one handle portion is extended outwardly from a second end of the at least one supporting portion and spatially corresponds to the second lateral side. The rotating shaft includes a first positioning element and a second positioning element disposed on an outer peripheral edge of the rotating shaft, respectively and extended along the axial direction of the rotating shaft. The elastic component is fixed to the base and includes a pushing portion. The pushing portion spatially corresponds to the first positioning element and the second positioning element of the rotating shaft. When the handle component is rotated relative to the base to a first position, the pushing portion and the first positioning element are engaged with each other, the pushing portion and the second positioning element are misaligned with each other, the at least one handle portion is separated from the second lateral side of the base, and the at least one supporting portion of the handle component is separated from the at least one accommodation space. When the handle component is rotated relative to the base to a second position, the pushing portion and the first positioning element are misaligned with each other, the pushing portion and the second positioning element are engaged with each other, the at least one handle portion is attached to the second lateral side of the base, and the at least one supporting portion of the handle component is accommodated in the at least one accommodation space.

In an embodiment, the first positioning element and the second positioning element are a concave portion, respectively, and the pushing portion is a convex portion corresponding to the concave portion.

In an embodiment, the elastic component includes a fixing portion. The fixing portion and the pushing portion are disposed at two opposite ends of the elastic component, respectively. The base includes a fastening hole, and the fixing portion includes a fastening component. The fastening component and the fastening hole are engaged with each other, so as to fix the elastic component on the base.

In an embodiment, the handle component includes an operating portion. The at least one handle portion and the operating portion are opposite to the rotating shaft and disposed at the second end of the supporting portion. The operating portion is a half-moon shaped slot concavely disposed from the second end to the first end of the supporting portion.

In an embodiment, the at least one handle portion includes two handle portions. The two handle portions are symmetrically disposed with each other and extended along a direction parallel to the second lateral side, respectively. A T-shaped structure is collaboratively formed by the two handle portions and the at least one supporting portion.

In an embodiment, the at least one supporting portion further includes a hollow groove spatially corresponding to the at least one accommodation space. When the handle component is rotated relative to the base to the second position, the hollow groove and the at least one accommodation space are overlapped with each other.

In an embodiment, the pivot slot is passed through a bottom surface of the base. The rotating shaft is inserted into the pivot slot through the bottom surface of the base from bottom to top. The elastic component is disposed on the bottom surface of the base. The pushing portion of the elastic component is constantly pushed against the rotating shaft in the pivot slot.

In an embodiment, the base includes an installation hole passed through the base. The installation hole is configured to fasten the base on the boat.

In an embodiment, the base includes a positioning convex portion. The positioning convex portion is disposed in the at least one accommodation space and adjacent to the second lateral side. The at least one supporting component includes a positioning concave portion. The positioning concave portion spatially corresponds to the positioning convex portion. When the handle component is rotated relative to the base to the second position, the positioning convex portion and the positioning concave portion are engaged with each other.

In an embodiment, the at least one accommodation space includes a first accommodation space and a second accommodation space. The base includes a convex block disposed between the first accommodation space and the second accommodation space. The at least one supporting portion includes a first supporting portion and a second supporting portion. The first supporting portion and the second supporting portion spatially correspond to the first accommodation space and the second accommodation space, respectively. When the handle component is rotated relative to the base to the second position, the first supporting portion is accommodated in the first accommodation space, the second supporting portion is accommodated in the second accommodation space, and the convex block is located between the first supporting portion and the second supporting portion.

DETAILED DESCRIPTION OF THE PREFERRED EMBODIMENT

Figure 1A:
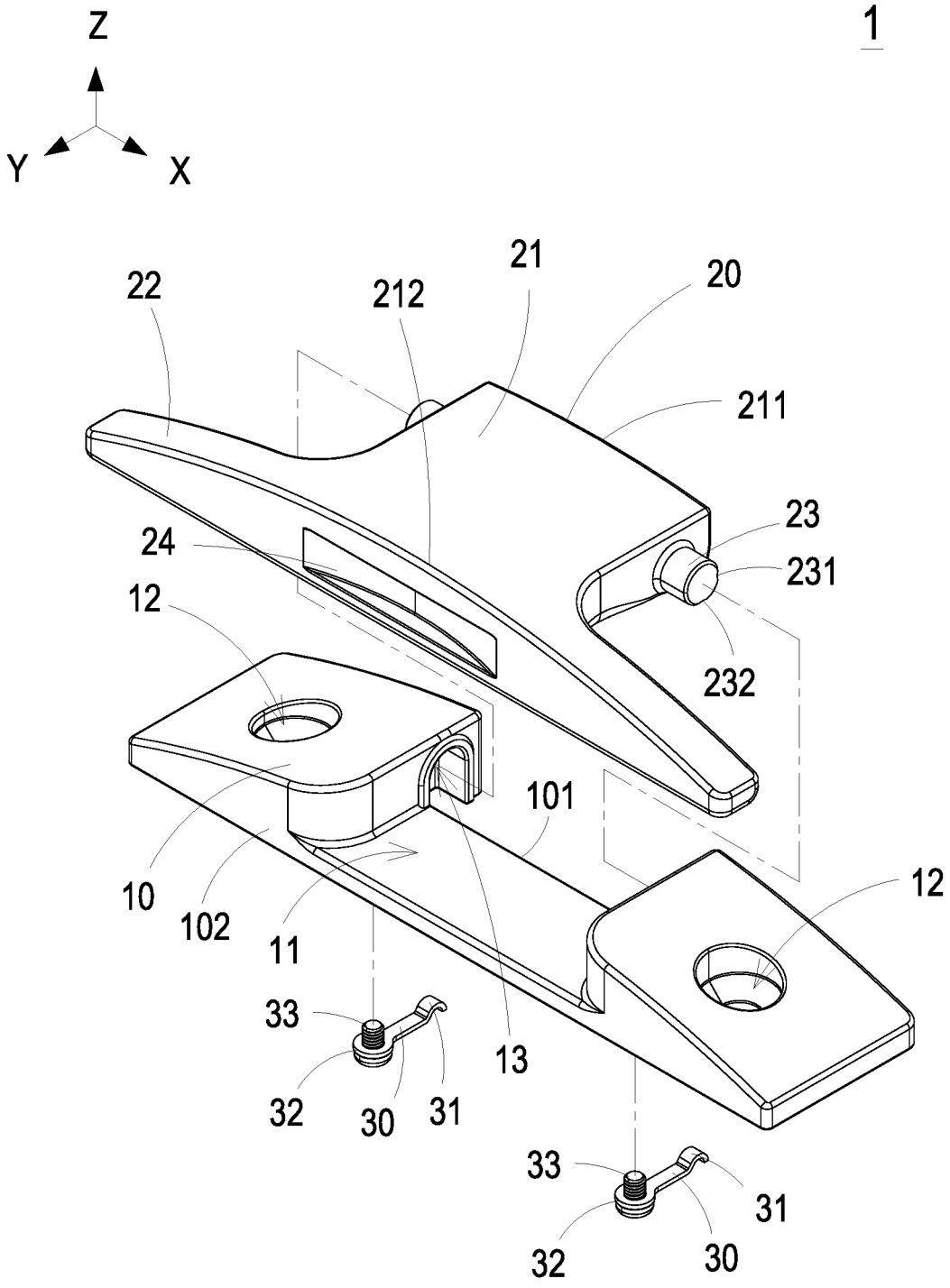
FIG. 1A is an exploded view illustrating a folding cleat according to a first embodiment of the present disclosure.

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When an element is referred to as being "connected," or "coupled," to another element, it can be directly connected or coupled to the other element or intervening elements may be present. Although the wide numerical ranges and parameters of the present disclosure are approximations, numerical values are set forth in the specific examples as precisely as possible. In addition, although the "first," "second," "third," and the like terms in the claims be used to describe the various elements can be appreciated, these elements should not be limited by these terms, and these elements are described in the respective embodiments are used to express the different reference numerals, these terms are only used to distinguish one element from another element. For example, a first element could be termed a second element, and, similarly, a second element could be termed a first element, without departing from the scope of example embodiments. Besides, "and/or"

and the like may be used herein for including any or all combinations of one or more of the associated listed items. Alternatively, the word "about" means within an acceptable standard error of ordinary skill in the art-recognized average. In addition to the operation/working examples, or unless otherwise specifically stated otherwise, in all cases, all of the numerical ranges, amounts, values and percentages, such as the number for the herein disclosed materials, time duration, temperature, operating conditions, the ratio of the amount, and the like, should be understood as the word "about" decorator. Accordingly, unless otherwise indicated, the numerical parameters of the present invention and scope of the appended patent proposed is to follow changes in the desired approximations. At least, the number of significant digits for each numerical parameter should at least be reported and explained by conventional rounding technique is applied. Herein, it can be expressed as a range between from one endpoint to the other or both endpoints. Unless otherwise specified, all ranges disclosed herein are inclusive.

Figure 1B:
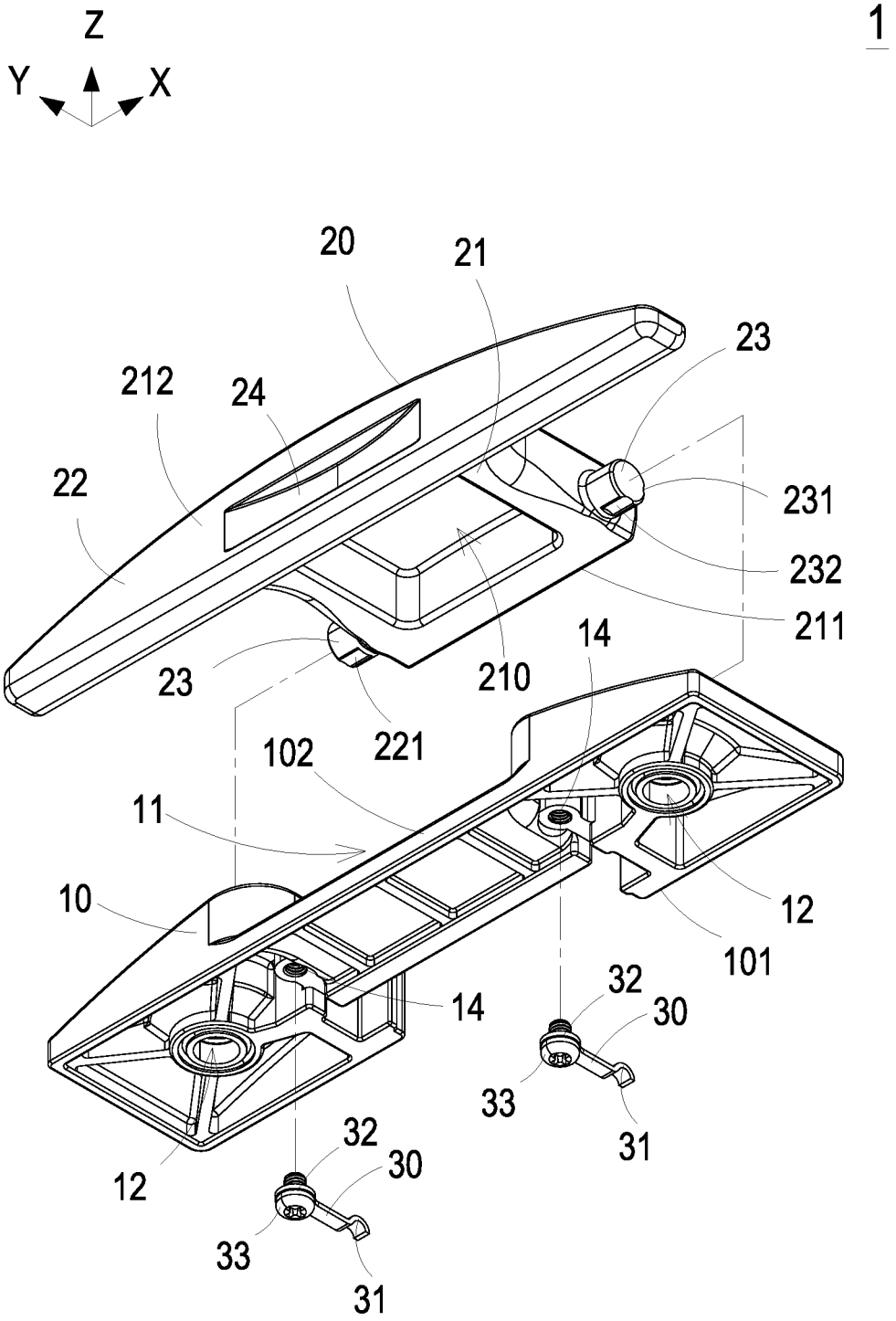
FIG. 1B is an exploded view illustrating the folding cleat according to the first embodiment of the present disclosure and taken from another perspective.
Figure 2A:
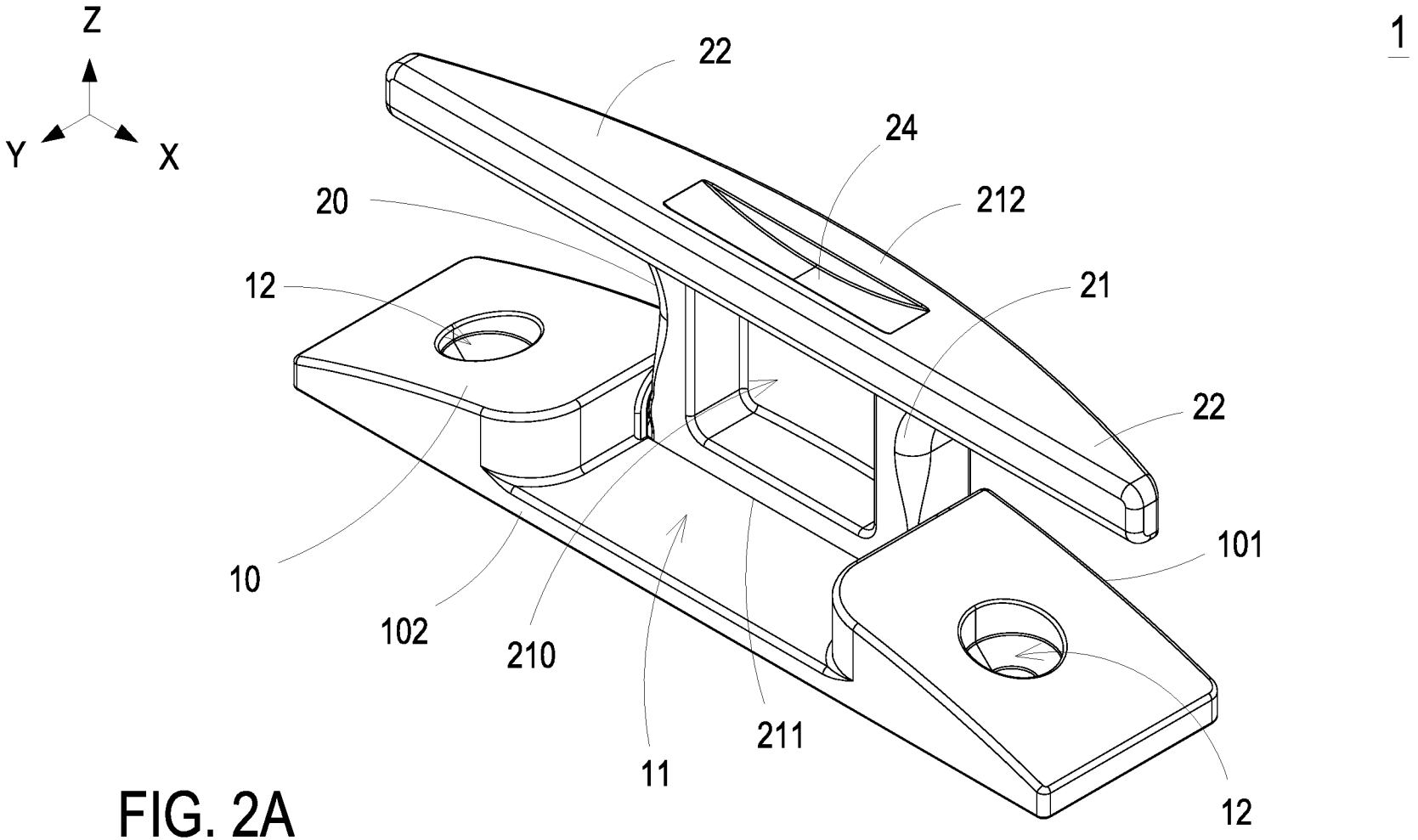
FIG. 2A is a schematic view illustrating the handle component of the folding cleat rotated to a first position according to the first embodiment of the present disclosure.
Figure 2B:
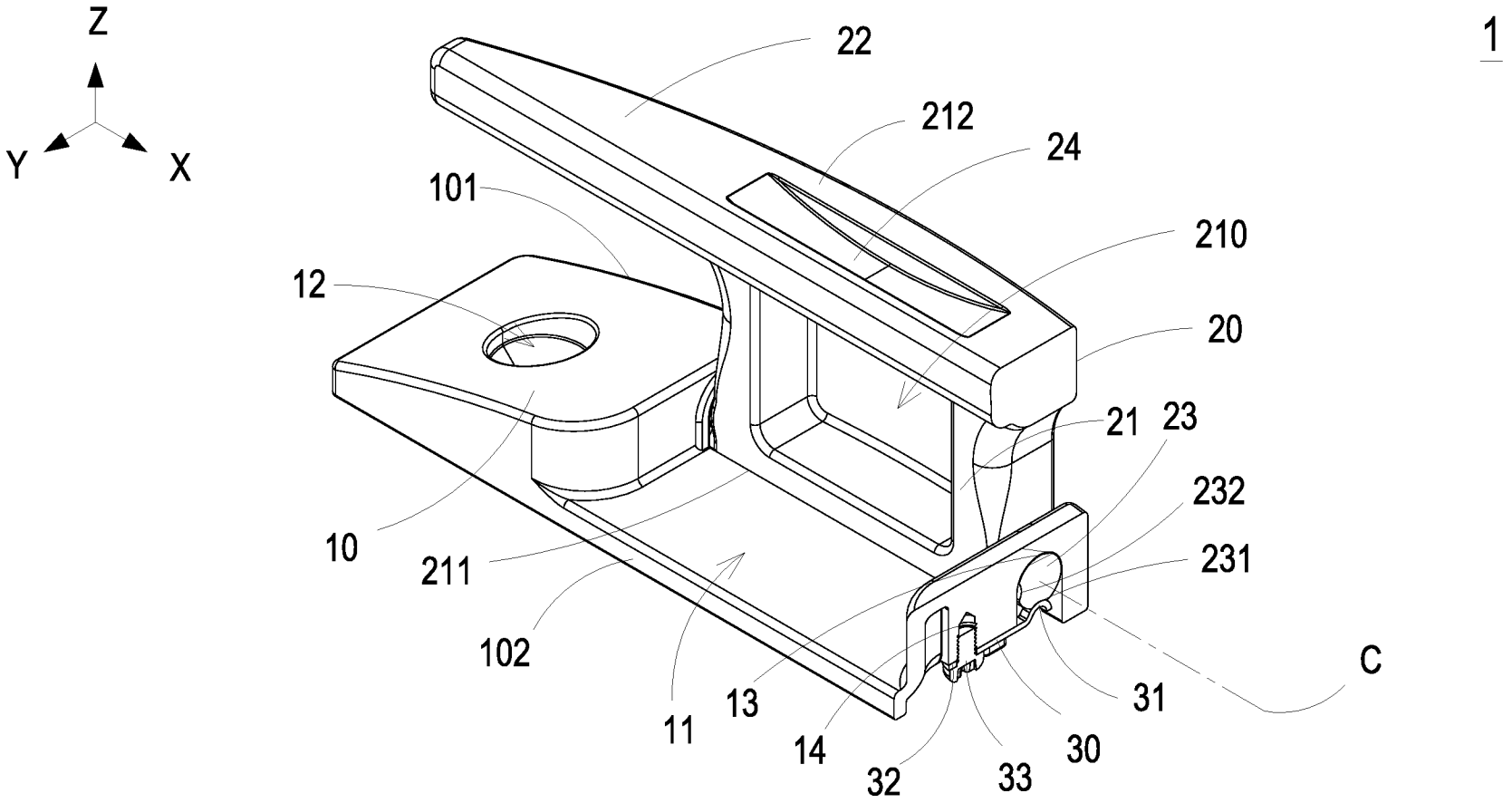
FIG. 2B is a cross-sectional structure of the folding cleat shown in FIG. 2A.
Figure 3A:
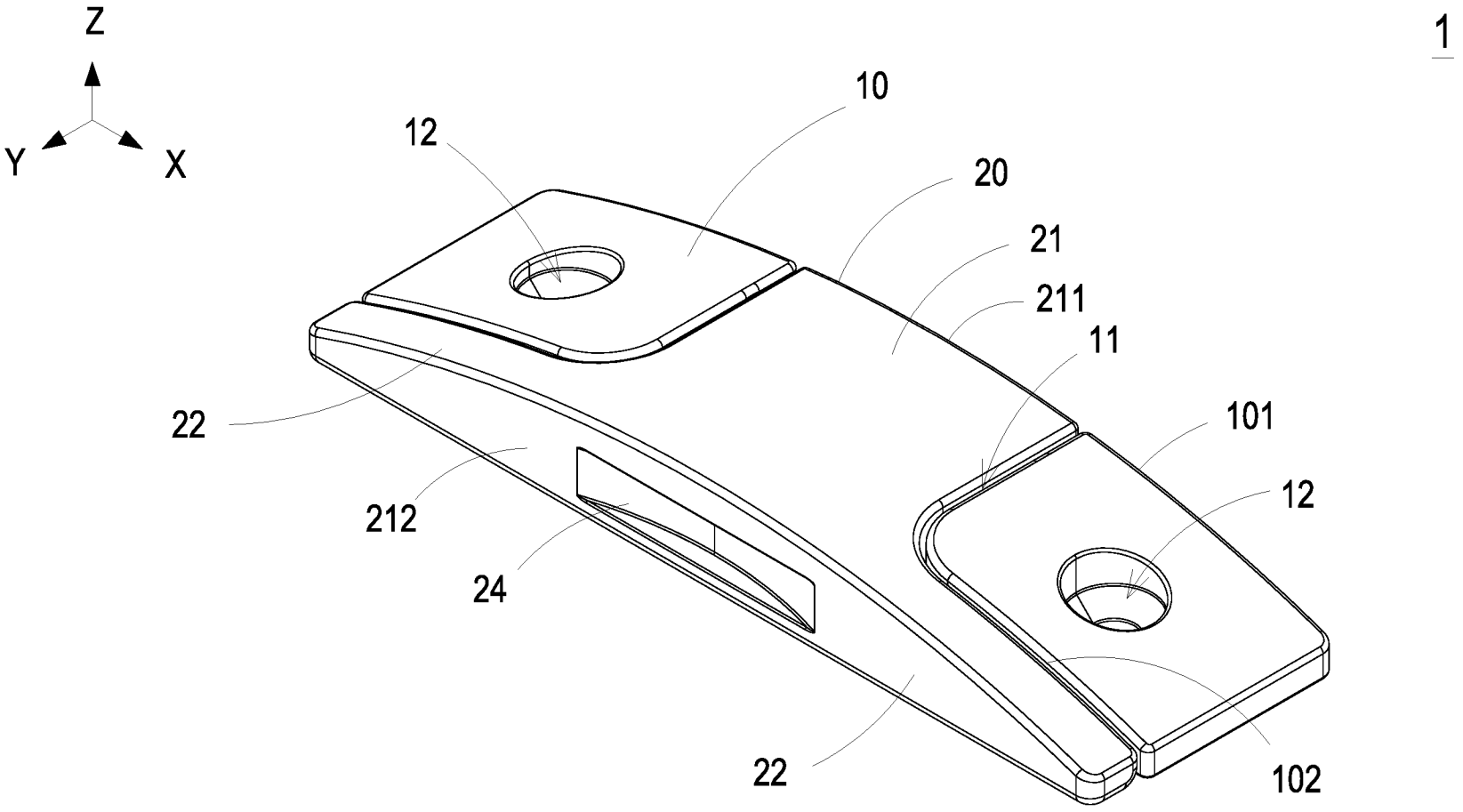
FIG. 3A is a schematic view illustrating the handle component of the folding cleat rotated to a second position according to the first embodiment of the present disclosure.
Figure 3B:
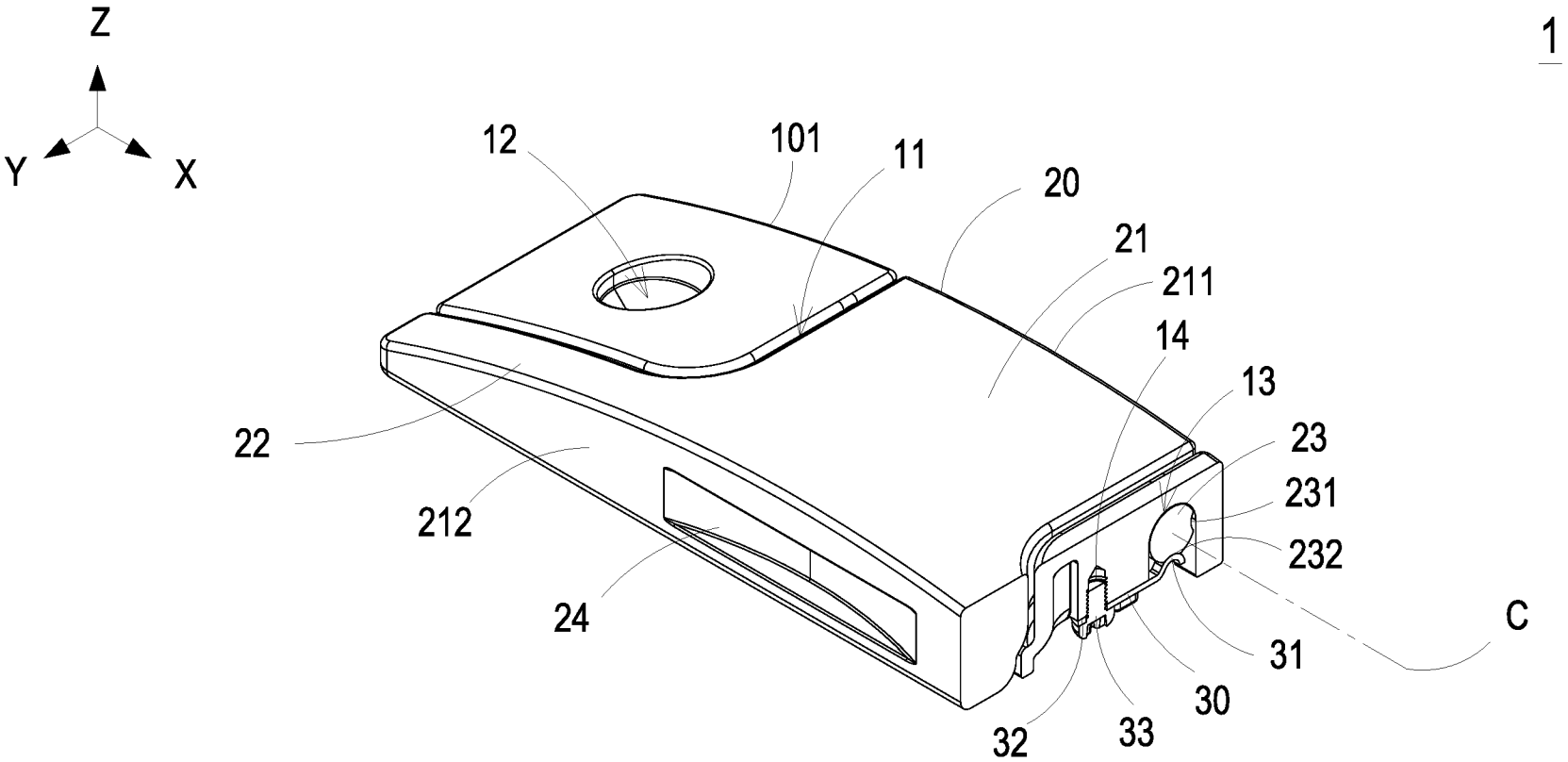
FIG. 3B is a cross-sectional structure of the folding cleat shown in FIG. 3A.

FIGS. 1A and 1B are exploded views illustrating a folding cleat according to a first embodiment of the present disclosure. FIG. 2A is a schematic view illustrating the handle component of the folding cleat rotated to a first position according to the first embodiment of the present disclosure. FIG. 2B is a cross-sectional structure of the folding cleat shown in FIG. 2A. FIG. 3A is a schematic view illustrating the handle component of the folding cleat rotated to a second position from the first embodiment of the present disclosure. FIG. 3B is a cross-sectional structure of the folding cleat shown in FIG. 3A. In the embodiment, the folding cleat 1 includes a base 10, a handle component 20 and an elastic component 30. Preferably but not exclusively, the base 10 is configured to be installed on a boat. Certainly, the application of the folding cleat 1 of the present disclosure is not limited thereto. In other embodiments, the base 10 is installed on a vehicle with limited operating space, such as a camper. In the embodiment, the base 10 includes a first lateral side 101, a second lateral side 102, a pivot slot 13 and at least one accommodation space 11. The first lateral side 101 and the second lateral side 102 are two opposite sides parallel to an X-axis. Preferably but not exclusively, the first lateral side 101 and the second lateral side 102 are two opposite and parallel long sides of the folding cleat 1. The pivot slot 13 is disposed adjacent to the first lateral side 101. The at least one accommodation space 11 is disposed between the first lateral side 101 and the second lateral side 102. The pivot slot 13 and the at least one accommodation space 11 are in communication with each other. In the embodiment, the handle component 20 is rotatably connected to the base 10. The handle component 20 includes at least one supporting portion 21 and at least one handle portion 22. The at least one supporting portion 21 includes a rotating shaft 23 disposed at a first end 211 of the at least one supporting portion 21 and passed through the pivot slot 13 of the base 10. In that, the at least one supporting portion 21 of the handle component 20 is pivotally connected to the base 10. In the embodiment, the pivot slot 13 is disposed at the two lateral sides of the at least one accommodation space 11. Preferably but not exclusively, when the rotating shaft 23 is inserted into the pivot slot 13, an axial direction C of the rotating shaft 23 is parallel to the X-axis, and the first end 211 of the at least one supporting portion 21 is at least partially accommodated in the at least one accommodation space 11. Certainly, the numbers of the at least one accommodation space 11, the pivot slot 13, the at least one supporting portion 21 and the rotating shaft 23 of the present disclosure are adjustable according to the practical requirements, but not limited thereto. In the embodiment, the at least one handle portion 22 is extended outwardly from a second end 212 of the at least one supporting portion 21 and parallel to a direction such as the direction of the X-axis, and spatially corresponds to the second lateral side 102. Preferably but not exclusively, in the embodiment, the at least one handle portion 22 includes two handle portions. The two handle portions 22 are symmetrically disposed with each other and respectively extended along a direction approximately parallel to the direction of the second lateral side 102 or the direction of the X-axis. Preferably but not exclusively, in the embodiment, a T-shaped structure is collaboratively formed by the two handle portions 22 and the at least one supporting portion 21, so that the function of fixing a rope is provided with the unfolded folding cleat 1. Moreover, in the embodiment, the rotating shaft 23 further includes a first positioning element 231 and a second positioning element 232 respectively disposed on an outer peripheral edge of the rotating shaft 23 and extended along the axial direction C of the rotating shaft 23. The elastic component 30 is fixed to the base 10 and includes a pushing portion 31. The pushing portion 31 spatially corresponds to the first positioning element 231 and the second positioning element 232 of the rotating shaft 23. It is noted that the number of the pushing portion 31 of the elastic component 30 is relative to the number of the rotating shaft 23 in the pivot slot 13. The present disclosure is not limited thereto. In the embodiment, the two pushing portions 31 of the elastic component 30 correspond to the two rotating shafts 23 in the pivot slots 13, respectively. Certainly, the method of fixing the elastic component 30 to the base 10 is adjustable according to the practical requirements. The present disclosure is not limited thereto. In other embodiments, the elastic component 30 is fixed to the base 10 by methods such as insertion or partial embedding.

In the embodiment, the handle component 20 is rotatably connected to the base 10. As shown in FIGS. 2A and 2B, when the handle component 20 is rotated relative to the base 10 to a first position, the pushing portion 31 of the elastic component 30 and the first positioning element 231 of the rotating shaft 23 are engaged with each other, and the pushing portion 31 of the elastic component 30 and the second positioning element 232 of the rotating shaft 23 are misaligned with each other. Meanwhile, the at least one handle portion 22 of the handle component 20 is separated from the second lateral side 102 of the base 10, and the at least one supporting portion 21 of the handle component 20 is separated from the at least one accommodation space 11 of the base 10. Thereby, the folding cleat 1 is in an unfolded state, and the at least one handle portion 22 of the handle component 20 provides the function of fixing the rope. On the other hand, as shown in FIGS. 3A and 3B, when the handle component 20 is rotated relative to the base 10 to a second position, the pushing portion 31 of the elastic component 30 and the first positioning element 231 of the rotating shaft 23 are misaligned with each other, and the pushing portion 31 of the elastic component 30 and the second positioning element 232 of the rotating shaft 23 are engaged with each other. Meanwhile, the at least one handle portion 22 of the handle component 20 is attached to the second lateral side 102 of the base 10, and the at least one supporting portion 21 of the handle component 20 is accommodated in the at least one accommodation space 11 of the base 10. Thereby, the folding cleat 1 is in a folded state, and the handle component 20 and the base 10 are overlapped into a minimum volume, which facilitates installation and application in limited space.

In the embodiment, the rotating shaft 23 of the at least one supporting portion 21 is formed in the single axial direction C. The first positioning portion 231 and the second positioning portion 232 disposed on the rotating shaft 23 are a concave portion, respectively. Preferably but not exclusively, the concave portion is a recessed groove disposed along the axial direction C. In the embodiment, the pushing portion 31 of the elastic component 30 is a convex portion corresponding to the concave portion. Preferably but not exclusively, in an embodiment, the first positioning portion 231 and the second positioning portion 232 are a convex portion, respectively, and the pushing portion 31 of the elastic component 30 is a concave portion corresponding to the convex portion. Preferably but not exclusively, in other embodiments, the first positioning portion 231 and the second positioning portion 232, and the pushing portion 31 of the elastic component 30 are engaging elements that can be engaged with each other. The present disclosure is not limited thereto, and is not redundantly described herein.

In the embodiment, the elastic component 30 is for example but not limited to a metal flat spring. The pushing portion 31 and a fixing portion 32 are disposed at the two opposite ends of the elastic component 30, respectively. In the embodiment, the base 10 includes a fastening hole 14. Preferably but not exclusively, the fastening hole 14 is disposed on a bottom surface of the base 10. The fixing portion 32 of the elastic component 30 includes a fastening component 33, such as a screw. The fastening component 33 and the fastening hole 14 are engaged with each other through the fixing portion 32, so as to fix the elastic component 30 on the base 10. In the embodiment, the pushing portion 31 of the elastic component 30 is constantly pushed against the rotating shaft 23 in the pivot slot 13. In the embodiment, it is noted that the pivot slot 13 is passed through the bottom surface of the base 10, and the rotating shaft 23 of the at least one supporting portion 21 is inserted into the pivot slot 13 through the bottom surface of the base 10 from bottom to top and along a direction such as the direction of the Z-axis. After the rotating shaft 23 of the at least one supporting portion 21 is inserted into the corresponding pivot slot 13, the elastic component 30 is fastened to the bottom surface of the base 10 according to the method mentioned above. The pushing portion 31 of the elastic component 30 is constantly pushed against the rotating shaft 23 in the pivot slot 13. Thus, the entire structure of the folding cleat 1 of the present disclosure is compact and easy to be assembled. When the rotating shaft 23 of the handle component 20 is inserted into the pivot slot 13 of the base 10, the rotating shaft 23 of the handle component 20 is limited in the pivot slot 13 of the base 10 by fixing the elastic component 30 to the base 10, and the pushing portion 31 of the elastic component 30 is constantly pushed against the rotating shaft 23. Thereby, the folding cleat 1 is assembled. The purpose of fixing and positioning is achieved when the handle component 20 is rotated relative to the base 10. Furthermore, when the folding cleat 1 is folded as shown in FIG. 3A, the handle component 20 and the base 10 are overlapped into a minimum volume. It facilitates storage and application of the folding cleat 1 in a limited space.

In the embodiment, the handle component 20 further includes an operating portion 24. The at least one handle portion 22 and the operating portion 24 are opposite to the rotating shaft 23 and disposed at the second end 212 of the supporting portion 21. Preferably but not exclusively, in the embodiment, the operating portion 24 is a half-moon shaped slot concavely disposed from the second end 212 to the first end 211 of the supporting portion 21. It facilitates the user to rotate the handle component 20 relative to the base 10 through the operating portion 24, and the handle 20 is selectively positioned at the first position (as shown in FIG. 2A) or the second position (as shown in FIG. 2B).

In the embodiment, the at least one supporting portion 21 further includes a hollow groove 210 spatially corresponding to the at least one accommodation space 11 of the base 10. As shown in FIGS. 3A and 3B, when the handle component 20 is rotated relative to the base 10 to the second position, the hollow groove 210 of the at least one supporting portion 21 and the at least one accommodation space 11 of the base 10 are overlapped with each other. Thereby, the handle component 20 and the base 10 are folded into the minimum volume when the folding cleat 1 is folded. Furthermore, under the condition of maintaining the basic mechanical strength, the material and weight thereof are further reduced, and the cost is effectively reduced. Certainly, the present disclosure is not limited thereof. Moreover, in the embodiment, the base 10 includes an installation hole 12 passed through the base 10. The installation hole 12 is configured to fasten the base 10 on the boat by for example but not limited to a bolt penetratingly disposed therethrough. In that, the installation of the folding cleat 1 is achieved. Certainly, the method of fastening the base 10 on the boat is adjustable according to the practical requirements. The present disclosure is not limited thereto, and is not redundantly described herein.

Figure 4A:
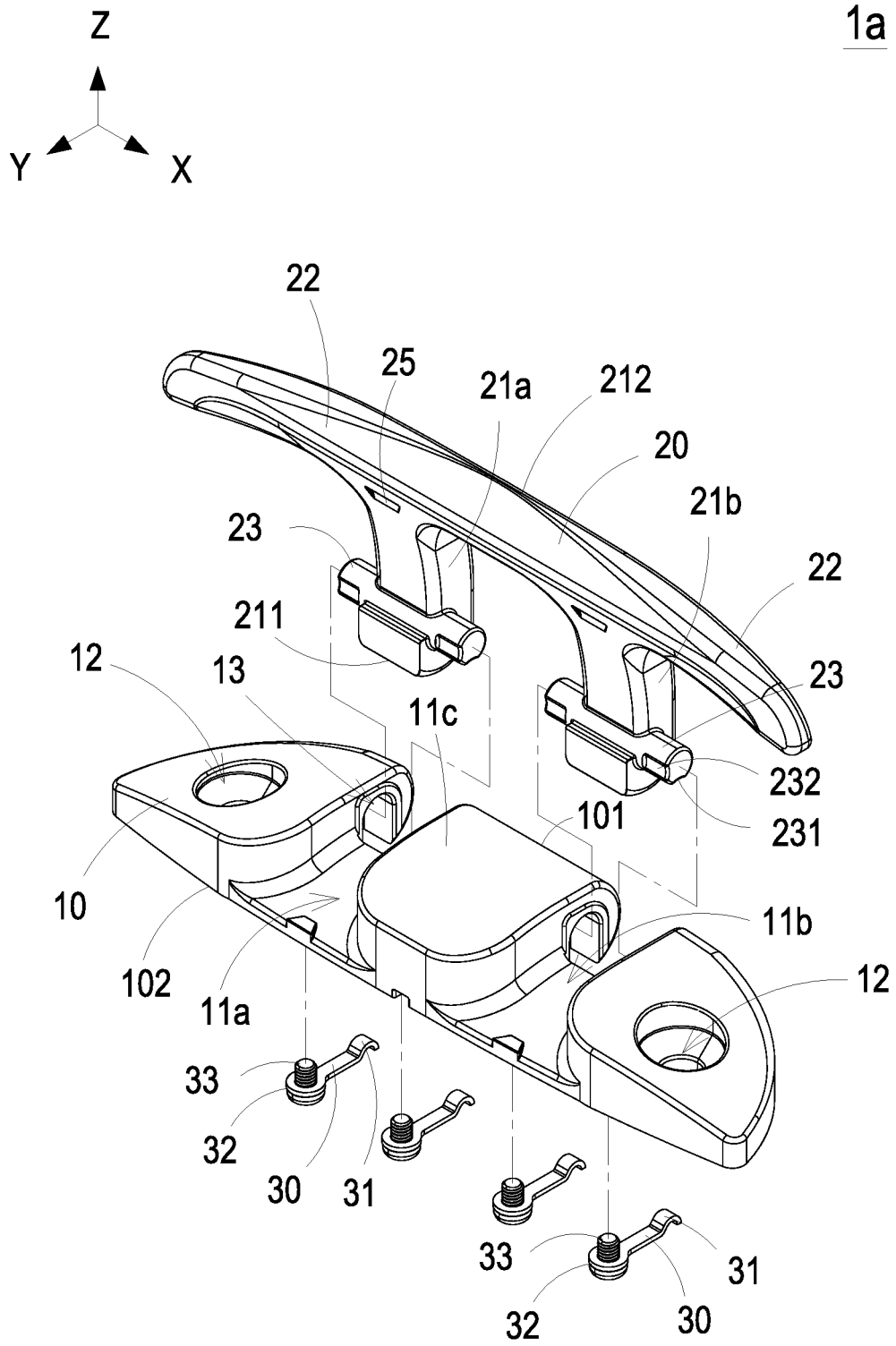
FIG. 4A is an exploded view illustrating a folding cleat according to a second embodiment of the present disclosure.
Figure 4B:
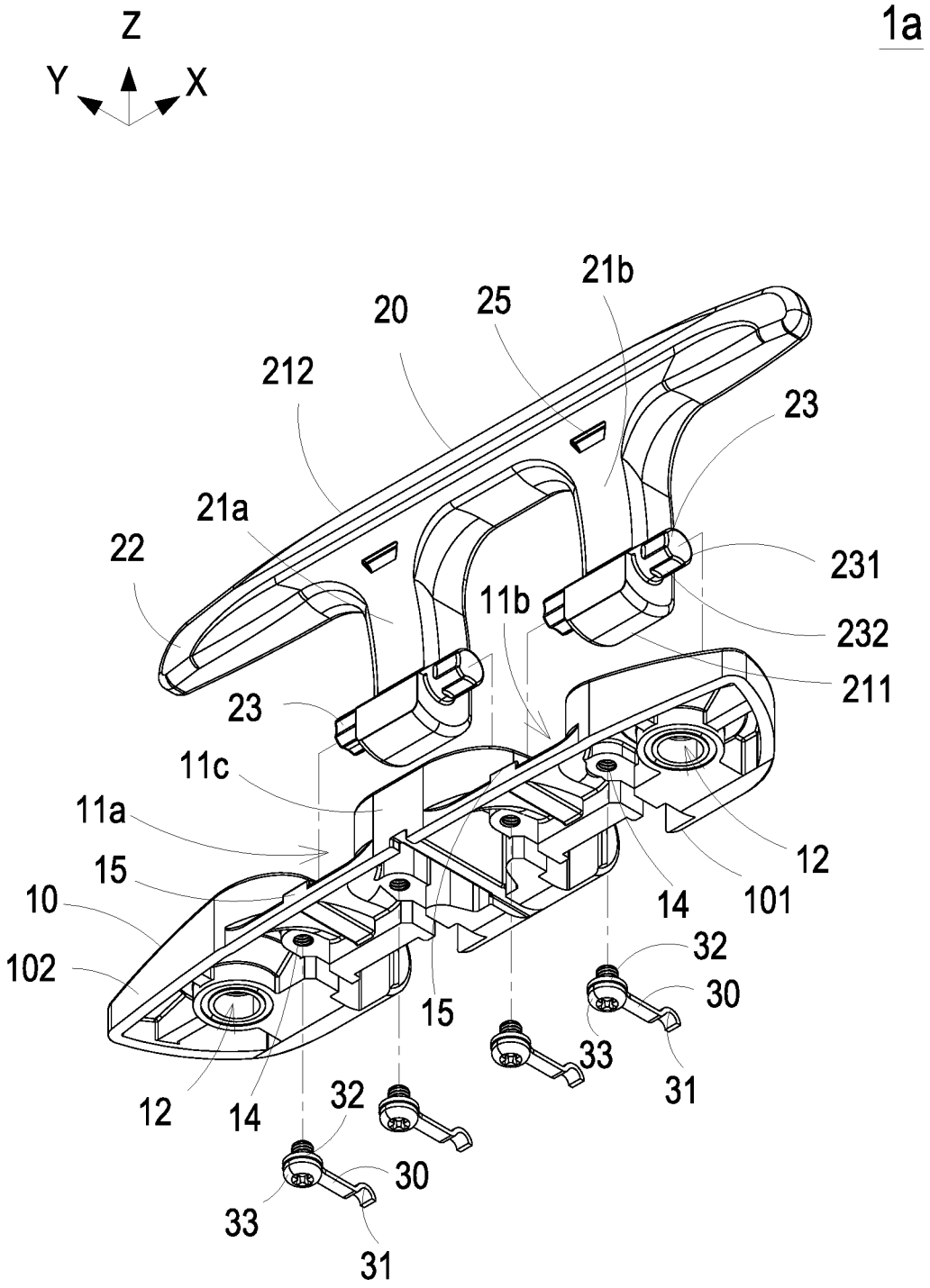
FIG. 4B is an exploded view illustrating the folding cleat according to the second embodiment and taken from another perspective.
Figure 5A:
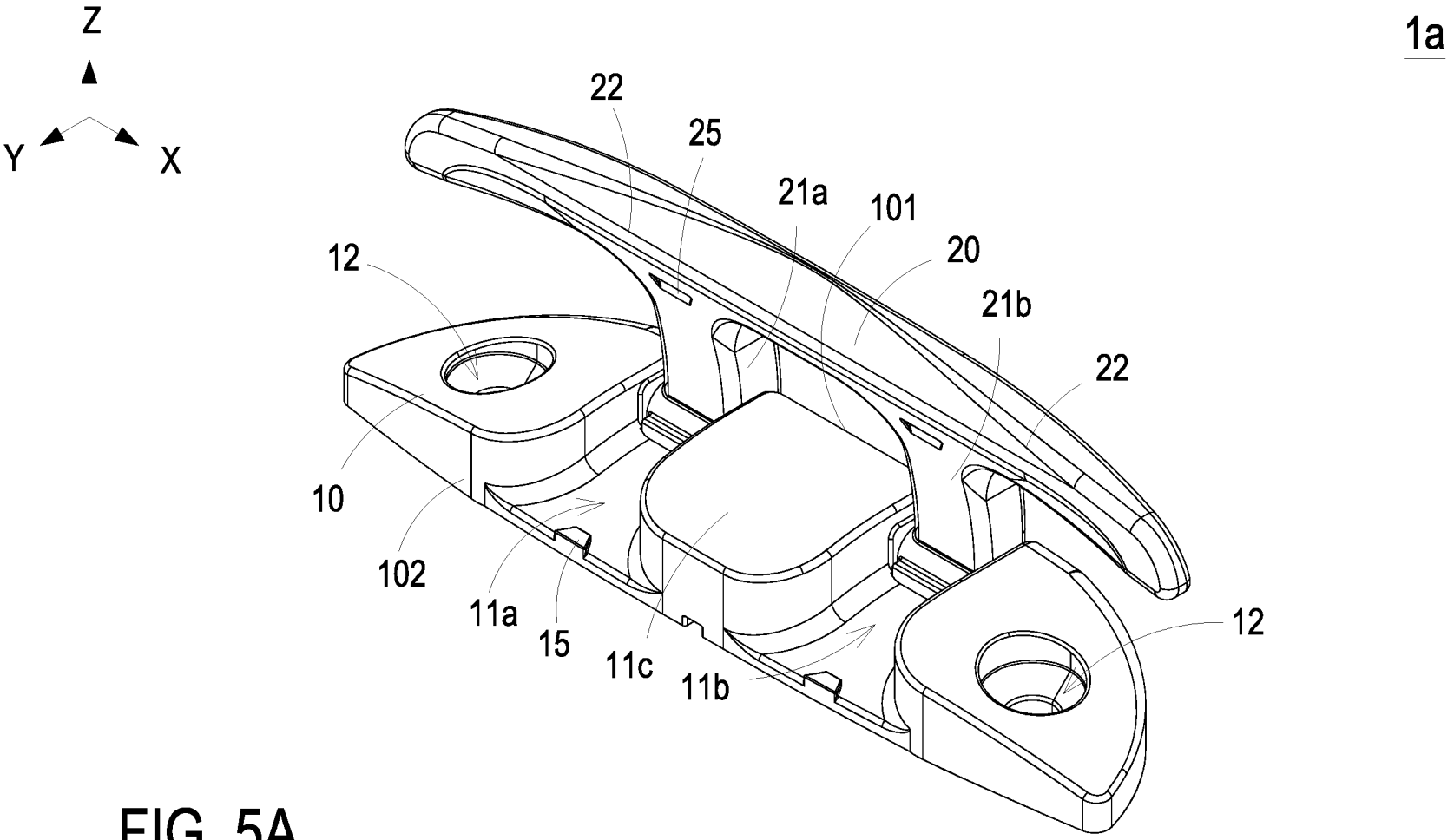
FIG. 5A is a schematic view illustrating the handle component of the folding cleat rotated to a first position according to the second embodiment of the present disclosure.
Figure 5B:
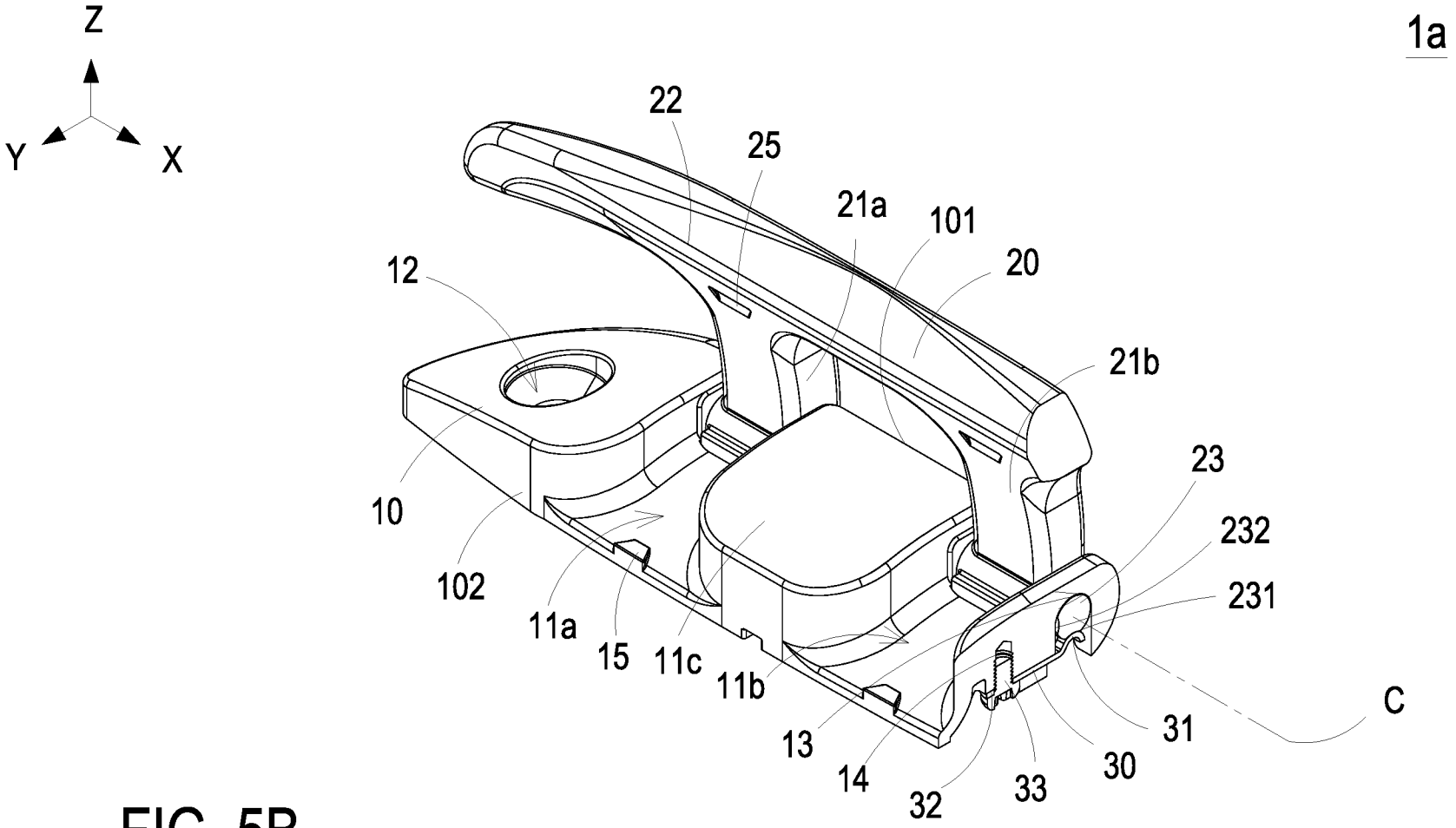
FIG. 5B is a cross-sectional structure of the folding cleat shown in FIG. 5A.
Figure 6A:
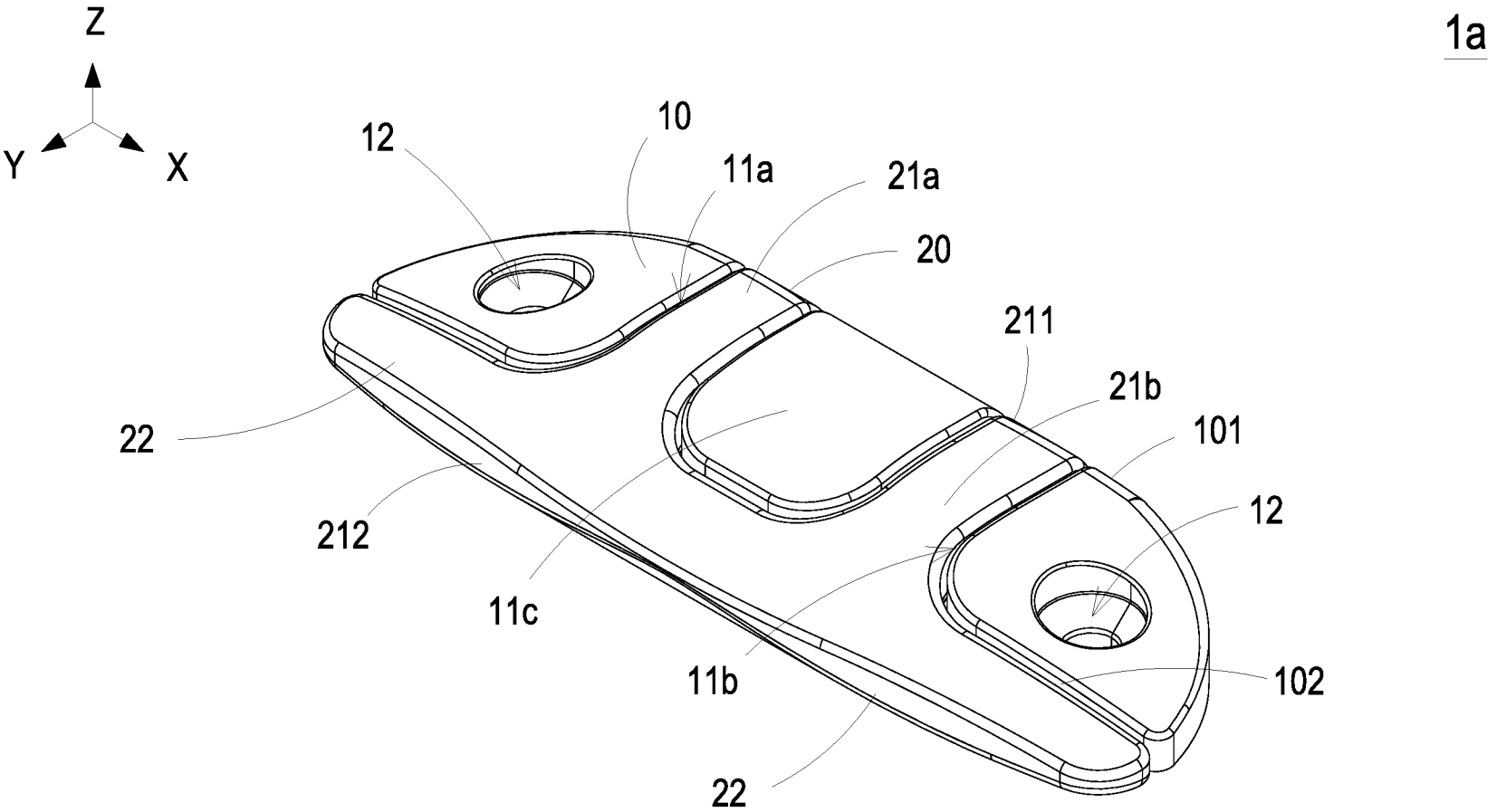
FIG. 6A is a schematic view illustrating the handle component of the folding cleat rotated to a second position according to the second embodiment of the present disclosure.
Figure 6B:
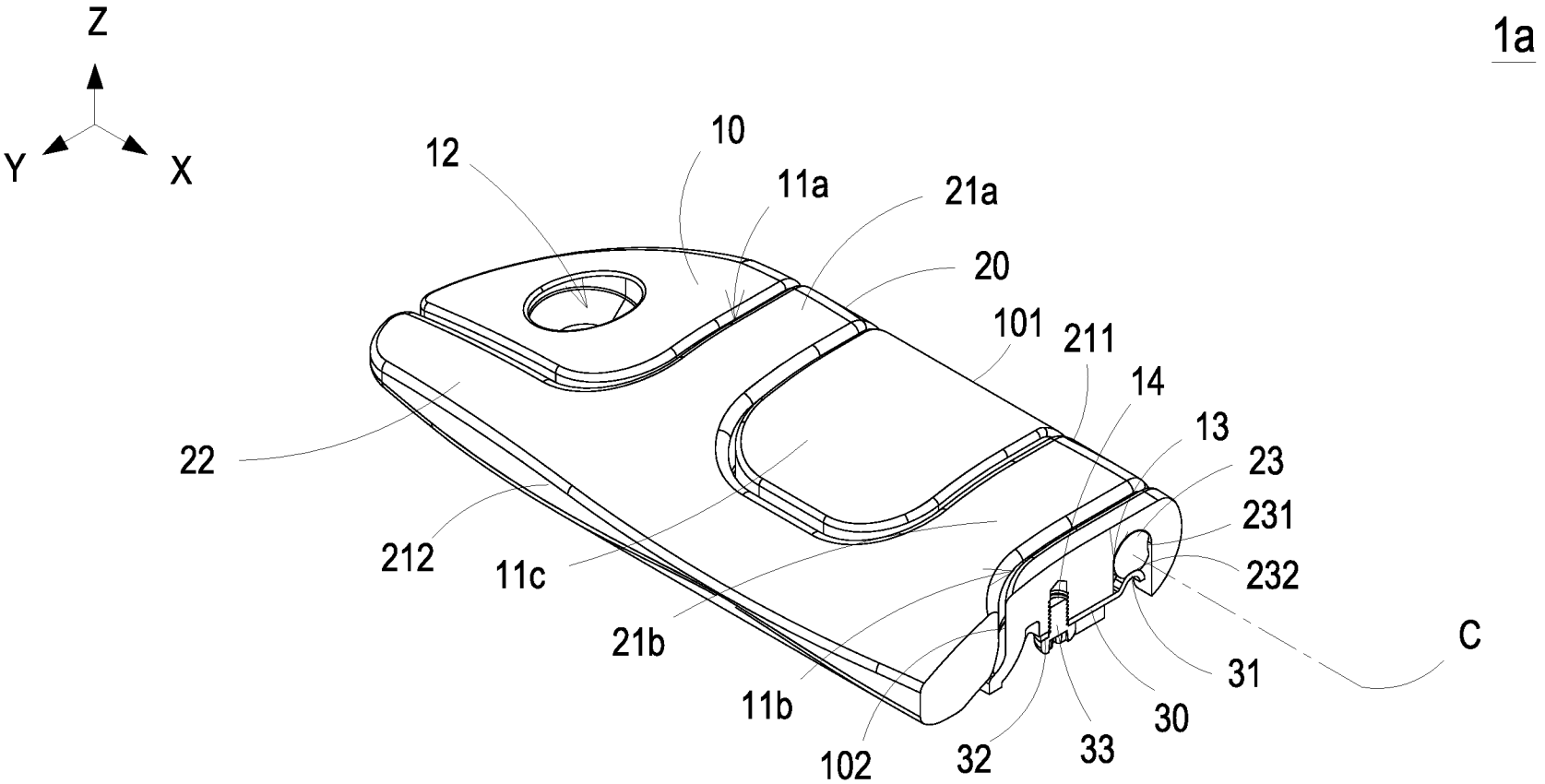
FIG. 6B is a cross-sectional structure of the folding cleat shown in FIG. 6A.

FIGS. 4A and 4B are exploded views illustrating a folding cleat according to a second embodiment of the present disclosure. FIG. 5A is a schematic view illustrating the handle component of the folding cleat rotated to a first position according to the second embodiment of the present disclosure. FIG. 5B is a cross-sectional structure of the folding cleat shown in FIG. 5A. FIG. 6A is a schematic view illustrating the handle component of the folding cleat rotated to a second position according to the second embodiment of the present disclosure. FIG. 6B is a cross-sectional structure of the folding cleat shown in FIG. 6A. In the embodiment, the structures, elements and functions of the folding cleat 1*a* are similar to those of the folding cleat 1 in FIGS. 1A to 3B, and are not redundantly described herein. In the embodiment, the base 10 further includes a first accommodation space 11*a*, a second accommodation space 11*b* and a convex block 11*c*. The convex block 11*c* is disposed between the first accommodation space 11*a* and the second accommodation space 11*b*. Furthermore, in the embodiment, the handle component 20 includes a first supporting portion 21*a*, a second supporting portion 21*b* and two handle portions 22. The first supporting portion 21*a* and the second supporting portion 21*b* of the handle component 20 spatially correspond to the first accommodation space 11*a* and the second accommodation space 11*b* of the base 10, respectively. In the embodiment, the rotating shaft 23 is disposed at the first end 211 collaboratively formed by the first supporting portion 21*a* and the second supporting portion 21*b*, and the two handle portions 22 are connected to the second end 212 collaboratively formed by the first supporting portion 21*a* and the second supporting portion 21*b*. It is noted that the numbers of the first supporting portion 21*a*, the second supporting portion 21*b*, the handle portion 22 and the rotating shaft 23 of the present disclosure are adjustable according to the practical requirements. The present disclosure is not limited thereto. In the embodiment, the rotating shaft 23 is disposed at the first end 211 of the first supporting portion 21*a* and the second supporting portion 21*b*. The rotating shaft 23 is extended along the axial direction C and passed through the pivot slot 13 of the corresponding base 10, so that the handle component 20 is rotatably connected to the base 10. Preferably but not exclusively, in another embodiment, the pivot slot 13 is disposed at a single side of the first supporting portion 21*a* or the second supporting portion 21*b*, and the corresponding rotating shaft 23 on the first supporting portion 21*a* or the second supporting portion 21*b* is extended along the axial direction C toward the single side. In other embodiments, the numbers and the arrangement of the pivot slot 13 and the rotating shaft 23 are adjustable according the practical requirements, and the present disclosure is not limited thereto. Furthermore, in the embodiment, the interval area between the first supporting portion 21*a* and the second supporting portion 21*b* is, for example, approximately the same shape as the convex block 11*c*. It facilitates the handle component 20 and the base 10 being overlapped into a minimum volume, and sufficient structural support is also provided.

In the embodiment, as shown in FIGS. 5A and 5B, when the handle component 20 is rotated relative to the base 10 to a first position, the pushing portion 31 of the elastic component 30 and the first positioning element 231 of the rotating shaft 23 are engaged with each other, and the pushing portion 31 of the elastic component 30 and the second positioning element 232 of the rotating shaft 23 are misaligned with each other. Meanwhile, the two handle portions 22 of the handle component 20 is separated from the second lateral side 102 of the base 10, and the first supporting portion 21*a* and the second supporting portion 21*b* of the handle component 20 are separated from the first accommodation space 11*a* and the second accommodation space 11*b* of the base 10, respectively. Thereby, the folding cleat 1*a* is in an unfolded state, and the at least one handle portion 22 of the handle component 20 provides the function of fixing the rope. On the other hand, as shown in FIGS. 6A and 6B, when the handle component 20 is rotated relative to the base 10 to a second position, the pushing portion 31 of the elastic component 30 and the first positioning element 231 of the rotating shaft 23 are misaligned with each other, and the pushing portion 31 of the elastic component 30 and the second positioning element 232 of the rotating shaft 23 are engaged with each other. Meanwhile, the two handle portions 22 of the handle component 20 are attached to the second lateral side 102 of the base 10. The first supporting portion 21*a* of the handle component 20 is accommodated in the first accommodation space 11*a* of the base 10, and the second supporting portion 21*b* of the handle component 20 is accommodated in the second accommodation space 11*b* of the base 10. The convex block 11*c* is accommodated in the interval area between the first supporting portion 21*a* and the second supporting portion 21*b*, and is located between the first supporting portion 21*a* and the second supporting portion 21*b*. Thereby, the folding cleat 1*a* is in a folded state, and the handle component 20 and the base 10 are overlapped into a minimum volume. It facilitates the folding cleat 1*a* to be installed and applied within a limited space.

In the embodiment, the base 10 further includes two positioning convex portion 15 disposed in the first accommodation space 11*a* and the second accommodation space 11*b*, respectively. The two positioning convex portion 15 are disposed adjacent to the second lateral side 102 of the base 10. The first supporting portion 21*a* and the second supporting portion 21*b* include a positioning concave portion 25, respectively. Each of the positioning concave portions 25 spatially corresponds to one of the positioning convex portion 15. In the embodiment, as shown in FIGS. 6A and 6B, when the handle component 20 is rotated relative to the base 10 to the second position, the positioning convex portion 15 and the corresponding positioning concave portions 25 are engaged with each other, so that the folding cleat 1*a* is stably maintained in the folded state.

In summary, the present disclosure provides a folding cleat with simple structure, convenient operation, safety, reliability, low cost and long service life of present disclosure is provided. By rotating a handle component relative to a base to fold and unfold the cleat, the cleat installed in a limited space on a boat not only provides the function of fixing the rope, but also achieves the effects of aesthetic appearance, safety, and convenience of storage. When a handle component is rotated relative to a base, an elastic component is pushed against a first positioning element or a second positioning element of a rotating shaft of the handle component, so that the handle component is positioned at a first position or a second position, respectively. Thereby, the purpose of fixing and positioning the handle component during folding and unfolding operations is achieved, the sliding or falling off of the handle component is avoided, and the safety of navigation is ensured. Furthermore, the entire structure of the folding cleat is compact and is easy to assemble. With a rotating shaft of a handle component inserted into a pivot slot of a base, the rotating shaft of the handle component is limited in the pivot slot of the base through an elastic component fixed to the base, and a pushing portion of the elastic component is constantly pushed against the rotating shaft. Thereby, the folding cleat is assembled. The purpose of fixing and positioning is achieved by rotating the handle component relative to the base. Furthermore, when the folding cleat is folded, the handle component and the base are overlapped into a minimum volume. It facilitates storage and application of the folding cleat in a limited space.

While the disclosure has been described in terms of what is presently considered to be the most practical and preferred embodiments, it is to be understood that the disclosure needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A folding cleat, comprising:

a base configured to be installed on a boat and comprising a first lateral side, a second lateral side, a pivot slot and at least one accommodation space, wherein the first lateral side and the second lateral side are two opposite sides, the pivot slot is disposed adjacent to the first lateral side, the at least one accommodation space is disposed between the first lateral side and the second lateral side, and the pivot slot and the at least one accommodation space are connected with each other;

a handle component rotatably connected to the base and comprising at least one supporting portion and at least one handle portion, wherein the at least one supporting portion comprises a rotating shaft disposed at a first end of the at least one supporting portion, extended along an axial direction and passed through the pivot slot, so that the at least one supporting portion is pivotally connected to the base, wherein the at least one handle portion is extended outwardly from a second end of the at least one supporting portion and spatially corresponds to the second lateral side, wherein the rotating shaft comprises a first positioning element and a second positioning element disposed on an outer peripheral edge of the rotating shaft, respectively, and extended along the axial direction of the rotating shaft; and an elastic component fixed to the base and comprising a pushing portion spatially corresponding to the first positioning element and the second positioning element of the rotating shaft, wherein when the handle component is rotated relative to the base to a first position, the pushing portion and the first positioning element are engaged with each other, the pushing portion and the second positioning element are misaligned with each other, the at least one handle portion is separated from the second lateral side of the base, and the at least one supporting portion of the handle component is separated from the at least one accommodation space, wherein when the handle component is rotated relative to the base to a second position, the pushing portion and the first positioning element are misaligned with each other, the pushing portion and the second positioning element are engaged with each other, the at least one handle portion is attached to the second lateral side of the base, and the at least one supporting portion of the handle component is accommodated in the at least one accommodation space.

2. The folding cleat according to claim 1, wherein the first positioning element and the second positioning element are a concave portion, respectively, and the pushing portion is a convex portion corresponding to the concave portion.

3. The folding cleat according to claim 1, wherein the elastic component comprises a fixing portion, and the fixing portion and the pushing portion are disposed at two opposite ends of the elastic component, respectively, wherein the base comprises a fastening hole, and the fixing portion comprises a fastening component, wherein the fastening component and the fastening hole are engaged with each other, so as to fix the elastic component on the base.

4. The folding cleat according to claim 1, wherein the handle component comprises an operating portion, and the at least one handle portion and the operating portion are opposite to the rotating shaft and disposed at the second end of the supporting portion, wherein the operating portion is a half-moon shaped slot concavely disposed from the second end to the first end of the supporting portion.

5. The folding cleat according to claim 1, wherein the at least one handle portion comprises two handle portions symmetrically disposed with each other and extended along a direction parallel to the second lateral side, respectively, wherein a T-shaped structure is collaboratively formed by the two handle portions and the at least one supporting portion.

6. The folding cleat according to claim 1, wherein the at least one supporting portion further comprises a hollow groove spatially corresponding to the at least one accommodation space, wherein when the handle component is rotated relative to the base to the second position, the hollow groove and the at least one accommodation space are overlapped with each other.

7. The folding cleat according to claim 1, wherein the pivot slot is passed through a bottom surface of the base, the rotating shaft is inserted into the pivot slot through the bottom surface of the base from bottom to top, the elastic component is disposed on the bottom surface of the base, and the pushing portion of the elastic component is constantly pushed against the rotating shaft in the pivot slot.

8. The folding cleat according to claim 1, wherein the base comprises an installation hole passed through the base, and the installation hole is configured to fasten the base on the boat.

9. The folding cleat according to claim 1, wherein the base comprises a positioning convex portion disposed in the at least one accommodation space and adjacent to the second lateral side, wherein the at least one supporting component comprises a positioning concave portion spatially corresponding to the positioning convex portion, wherein when the handle component is rotated relative to the base to the second position, the positioning convex portion and the positioning concave portion are engaged with each other.

10. The folding cleat according to claim 1, wherein the at least one accommodation space comprises a first accommodation space and a second accommodation space, and the base comprises a convex block disposed between the first accommodation space and the second accommodation space, wherein the at least one supporting portion comprises a first supporting portion and a second supporting portion, and the first supporting portion and the second supporting portion spatially correspond to the first accommodation space and the second accommodation space, respectively, wherein when the handle component is rotated relative to the base to the second position, the first supporting portion is accommodated in the first accommodation space, the second supporting portion is accommodated in the second accommodation space, and the convex block is located between the first supporting portion and the second supporting portion.

* * * * *